US005190196A

United States Patent [19]

Hamer, III

[11] Patent Number: 5,190,196

[45] Date of Patent: Mar. 2, 1993

[54] PAINT BALL MAGAZINE APPARATUS

[76] Inventor: Harry H. Hamer, III, 418 S. Frederick St., Mechanicsburg, Pa. 17055

[21] Appl. No.: 772,109

[22] Filed: Oct. 7, 1991

[51] Int. Cl.[5] ..... F42B 39/02

[52] U.S. Cl. ..... 224/208; 224/148; 224/196; 224/235; 224/239; 224/241; 220/377; 220/DIG. 13; 232/43.1

[58] Field of Search ..... 224/196, 148, 208, 209, 224/235, 241, 239, 203, 919; 124/49, 50, 45; 221/185, 281; 222/175, 561; 220/377, DIG. 13, 625; 232/43.1, 43.5, 43.3

[56] References Cited

U.S. PATENT DOCUMENTS

| | | | |
|---|---|---|---|
| 1,597,902 | 8/1926 | Kuck | 270/377 |
| 3,845,889 | 11/1974 | Hurd | 221/185 |
| 4,088,251 | 5/1978 | Rodriguez | 224/919 |

FOREIGN PATENT DOCUMENTS

| | | | |
|---|---|---|---|
| 1116567 | 1/1982 | Canada | 224/148 |

*Primary Examiner*—Linda J. Sholl
*Attorney, Agent, or Firm*—Leon Gilden

[57] ABSTRACT

A magazine apparatus for support about an individual's torso is provided to include an upper collar and lower collar in a spaced parallel relationship mounting a row of magazine tubes in a parallel relationship relative to one another orthogonally aligned relative to the upper and lower collars. The magazine tube is defined at an arcuate intersection of an upper and lower leg of each magazine tube, with the magazine tube including a transparent cap mounted to an upper end of each tube and a removable door plate formed with a spring hinged, or alternatively a slide plate permitting presentation of a paint ball member to be directed through each magazine tube.

4 Claims, 4 Drawing Sheets

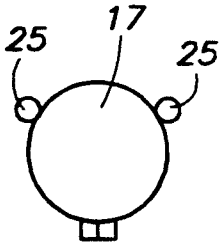
Fig 4
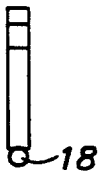
Fig 5
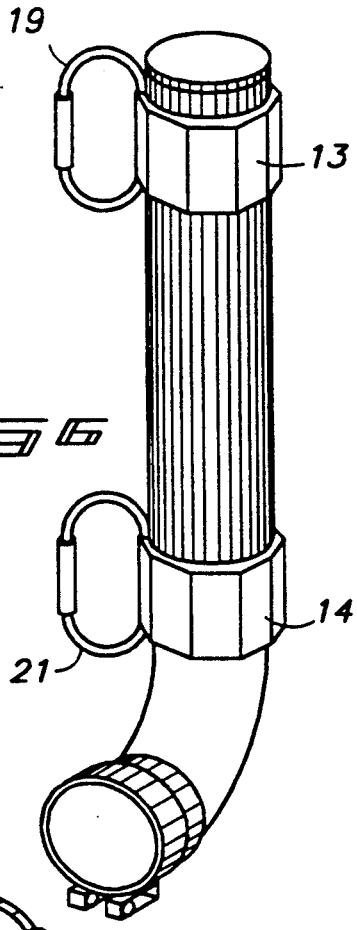
Fig 6
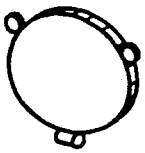
Fig 7
Fig 8
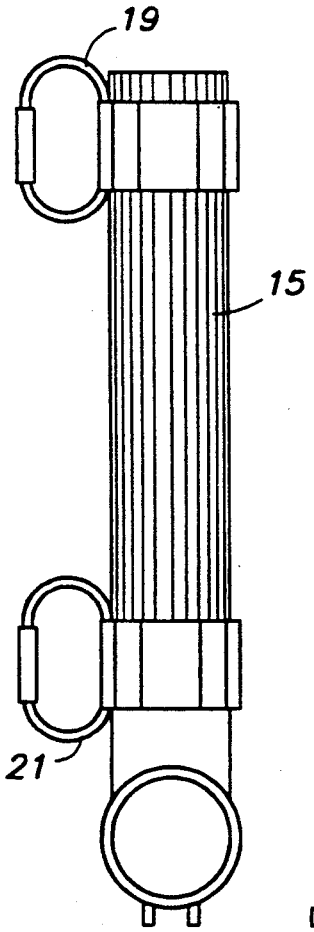
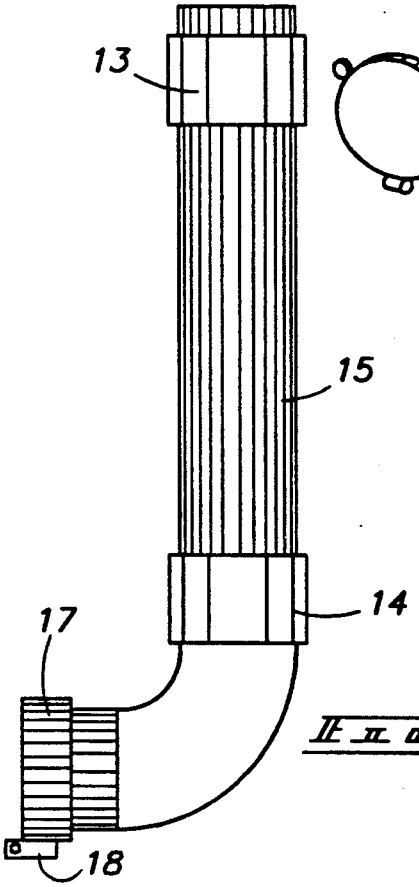
Fig 9

PAINT BALL MAGAZINE APPARATUS

BACKGROUND OF THE INVENTION

1. Field of the Invention

The field of invention relates to paint gun apparatus, and more particularly pertains to a new and improved paint ball magazine apparatus wherein the same is arranged to provide for ease of recharging of paint guns utilized in paint gun game playing.

2. Description of the Prior Art

Magazine tubes of various types are utilized throughout the prior art to provide for support of various components relative to an associated environment. Such magazine tubes are exemplified for example in U.S. Pat. No. 4,840,332 to Hoyt wherein a golf ball holder of a generally cylindrical configuration mounts a plurality or row of golf balls therewithin.

U.S. Pat. No. 3,497,118 to Najjar sets forth a further example of a cylindrical golf ball holder structure.

U.S. Pat. No. 4,936,282 to Dubbins, et al. sets forth an example of a paint gun member utilizing associated paint gun spheres to be utilized in a paint gun game playing procedure illustrating use of the spherical recharging paint balls as supported by the instant invention.

Accordingly, it may be appreciated that there continues to be a need for a new and improved paint ball magazine apparatus as set forth by the instant invention which addresses both the problems of ease of use as well as effectiveness in construction and in this respect, the present invention substantially fulfills this need.

SUMMARY OF THE INVENTION

In view of the foregoing disadvantages inherent in the known types of magazine apparatus now present in the prior art, the present invention provides a paint ball magazine apparatus wherein the same provides for supporting and dispensing of paint balls relative to a paint gun structure. As such, the general purpose of the present invention, which will be described subsequently in greater detail, is to provide a new and improved paint ball magazine apparatus which has all the advantages of the prior art magazine apparatus and none of the disadvantages.

To attain this, the present invention provides a magazine apparatus for support about an individual's torso to include an upper collar and a lower collar in a spaced parallel relationship mounting a row of magazine tubes in a parallel relationship relative to one another orthogonally aligned relative to the upper and lower collars. The magazine tube is defined at an arcuate intersection of an upper and lower leg of each magazine tube, with the magazine tube including a transparent cap mounted to an upper end of each tube and a removable door plate formed with a spring hinged, or alternatively a slide plate permitting presentation of a paint ball member to be directed through each magazine tube.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved paint ball magazine apparatus which has all the advantages of the prior art magazine apparatus and none of the disadvantages.

It is another object of the present invention to provide a new and improved paint ball magazine apparatus which may be easily and efficiently manufactured and marketed.

It is a further object of the present invention to provide a new and improved paint ball magazine apparatus which is of a durable and reliable construction.

An even further object of the present invention is to provide a new and improved paint ball magazine apparatus which is susceptible of a low cost of manufacture with regard to both materials and labor, and which accordingly is then susceptible of low prices of sale to the consuming public, thereby making such paint ball magazine apparatus economically available to the buying public.

Still yet another object of the present invention is to provide a new and improved paint ball magazine apparatus which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 4 is an orthographic front view of a door member utilized by each magazine tube.

FIG. 5 is an orthographic side view of the door, as set forth in FIG. 4.

FIG. 6 is an isometric illustration of the magazine tube structure with the door eliminated therefrom.

FIG. 7 is an isometric illustration of the door structure.

FIG. 8 is an orthographic front view of the magazine tube.

FIG. 9 is an orthographic side view of the magazine tube.

DESCRIPTION OF THE PREFERRED EMBODIMENT

Figure 1:
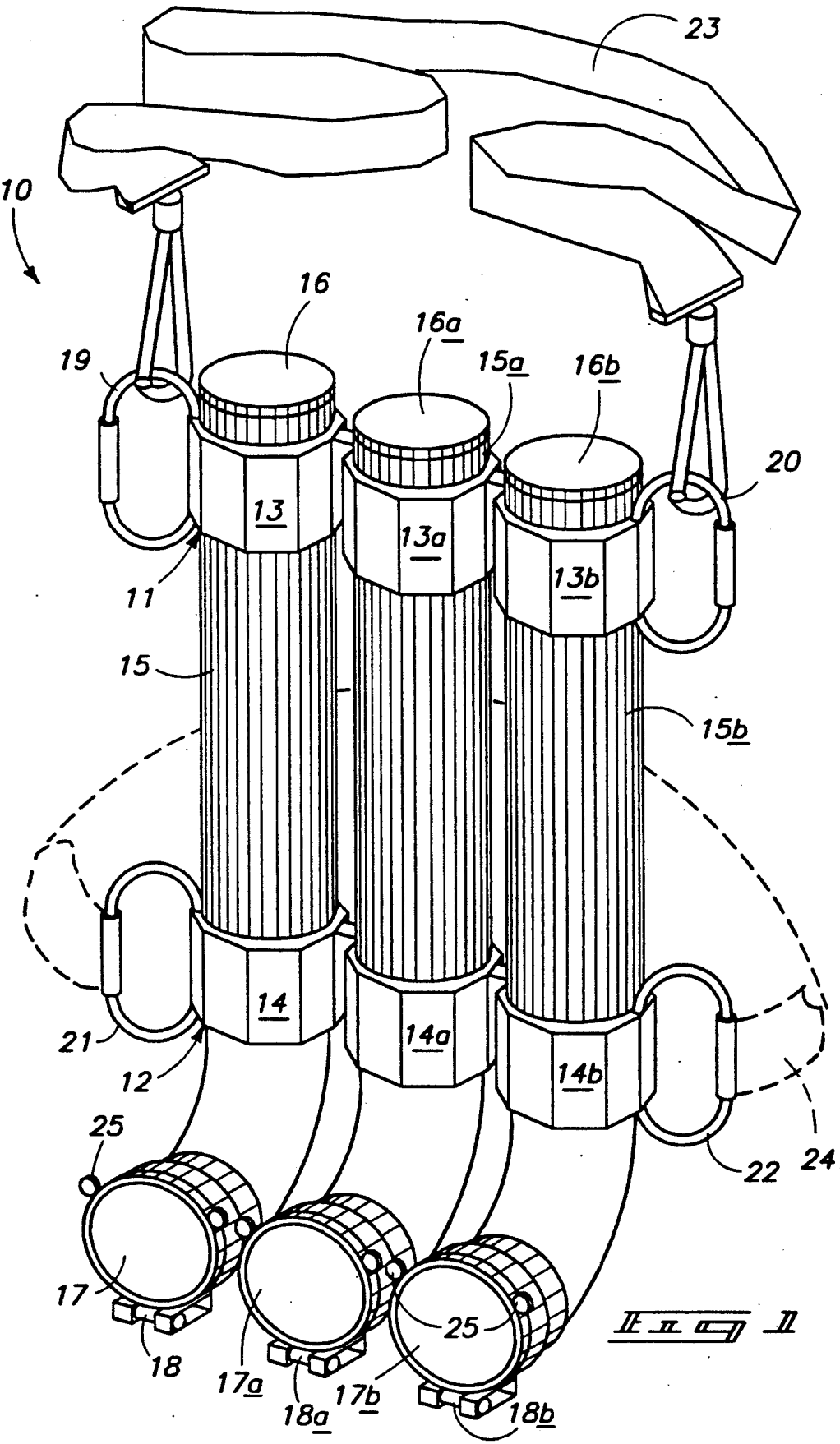
FIG. 1 is an isometric illustration of the instant invention.
Figure 2:
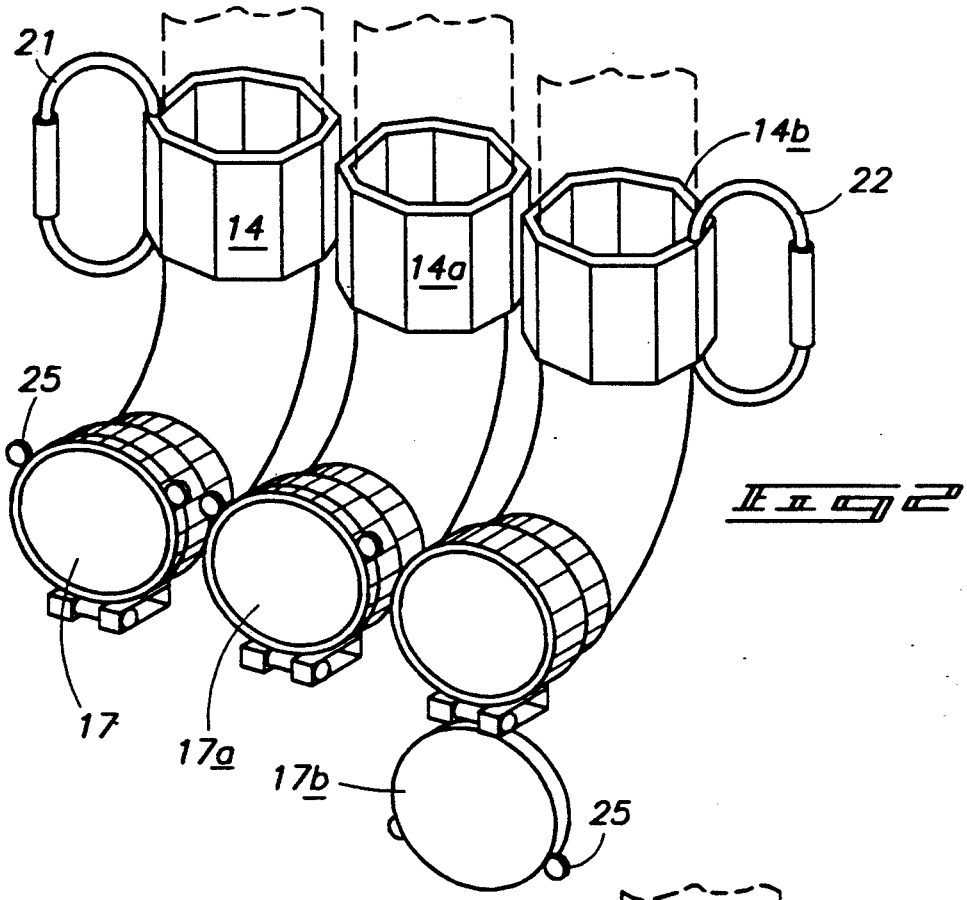
FIG. 2 is an isometric illustration of a lower portion of the paint ball magazine structure.

With reference now to the drawings, and in particular to FIGS. 1 to 12 thereof, a new and improved paint ball magazine apparatus embodying the principles and concepts of the present invention and generally designated by the reference numeral 10 will be described.

More specifically, the paint ball magazine apparatus 10 of the instant invention essentially comprises an upper collar 11 spaced from and parallel a lower collar 12. The upper collar 11 includes a row of upper support cylinders to include a first, second, and third upper support cylinder, wherein each of the support cylinders are in a linear fixedly mounted row whose axes are arranged in a parallel equally spaced relationship relative to one another. A row of lower support cylinders defined by a first, second, and third respective lower support cylinder are each aligned with a respective upper support cylinder to define coaxially aligned pairs of cylinders to include 13-14, 13*a*-14*a*, and 13*b*-14*b*. Each pair of support cylinders includes a respective first, second, and third respective "L" shaped magazine tube 15, 15*a*, and 15*b* directed and fixedly mounted within each support cylinder within each lower leg of each support cylinder arranged in a parallel relationship extending forwardly of the support cylinders. A respective first, second, and third transparent cap 16, 16*a*, and 16*b* is mounted to each upper terminal end of each respective first through third support cylinder to permit visual viewing of available paint balls of a type as utilized in the U.S. Pat. No. 4,936,282 to be observed therewithin. Each lower terminal end of each magazine tube includes a respective first, second, and third lower lid 17, 17*a*, and 17*b* respectively to include respective first, second, and third lid hinge 18, 18*a*, and 18*b*. The lid hinges may be of a spring biased type to maintain closure of each lower lid relative to each magazine tube, or alternatively may utilize friction clips 25 mounted peripherally to each lower lid for securement of each lower lid relative to a respective magazine tube.

The upper collar 11 includes a respective right and left upper collar loop 19 and 20, with the lower collar 12 including respective right and left lower collar loop 21 and 22. The upper collar loops secure an upper belt 23 to be positioned about an individual's neck, with the lower loops arranged to receive the spaced distal ends of a lower belt 24 to be secured about an individual's torso. Belts of various types may be utilized to include buckle adjustments, or alternatively elastomeric belts for ease of securement relative to an individual.

Figure 3:
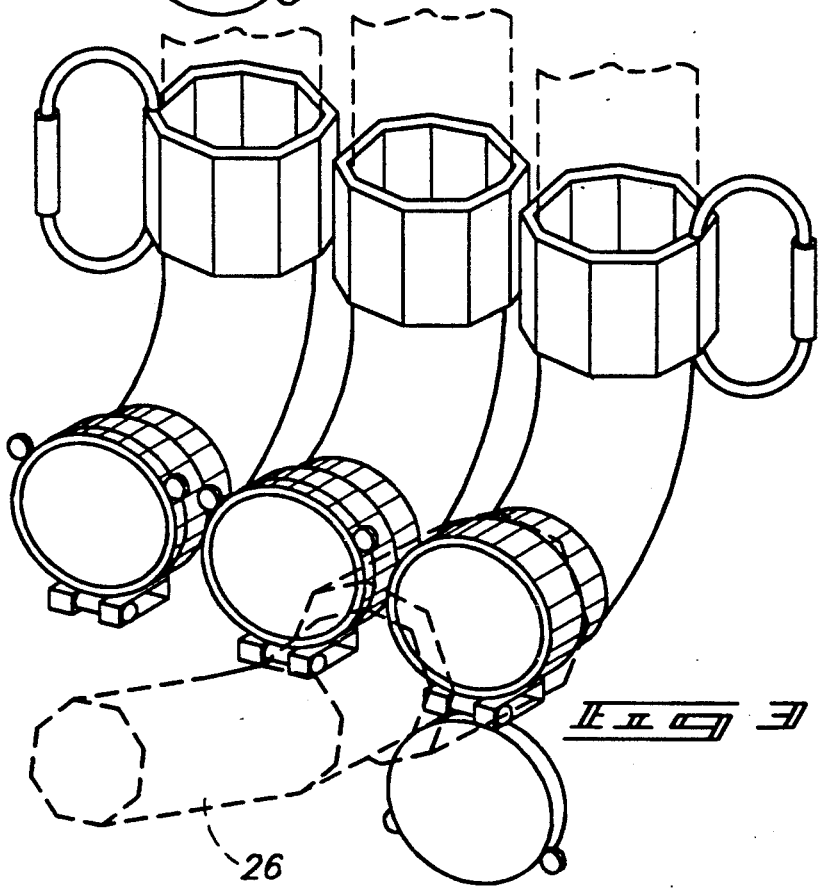
FIG. 3 is an isometric illustration illustrating the use of a magazine tube relative to a loading chute of an associated paint gun member.

The FIG. 3 illustrates alignment of an associated "whaler" relative to a lower distal end of each magazine tube for recharging of an associated gun, of a type as illustrated in the U.S. Pat. No. 4,936,282.

Figure 10:
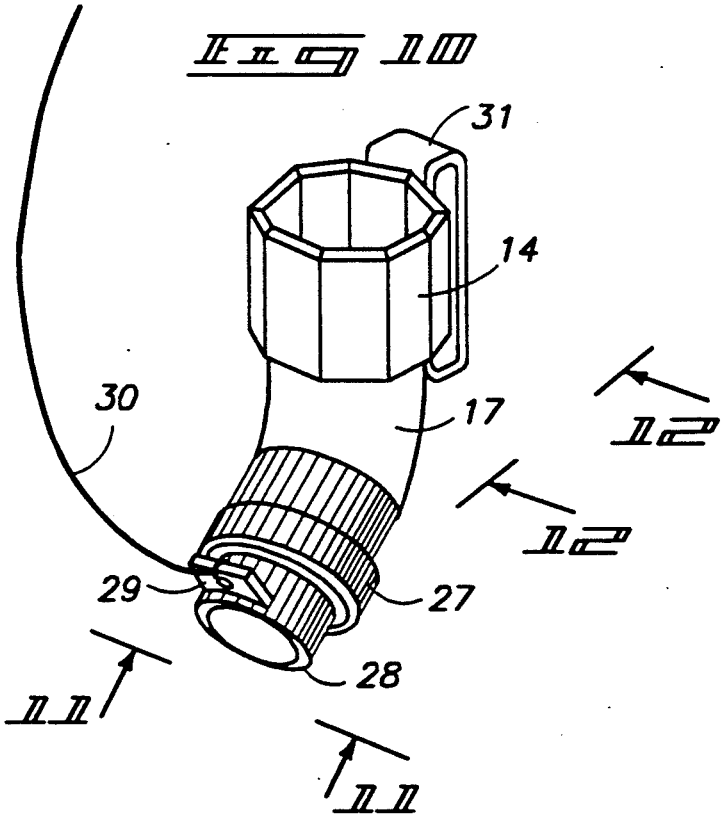
FIG. 10 is an isometric illustration of a modified door structure utilized by the invention.
Figure 12:
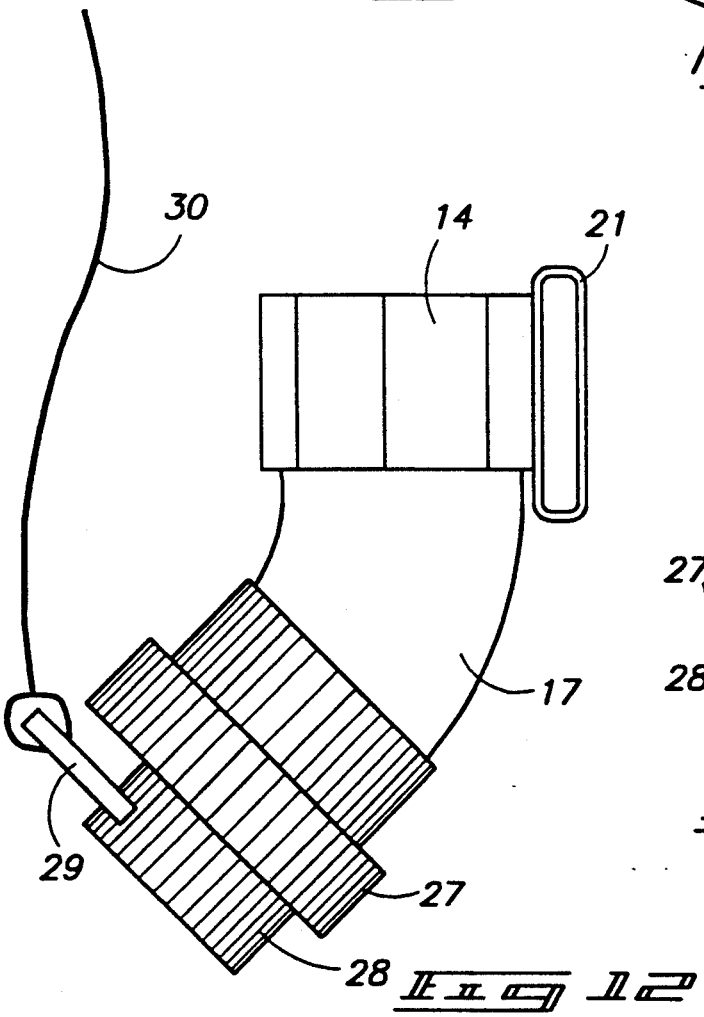
FIG. 12 is an orthographic side view, taken along the lines 12—12 of FIG. 10 in the direction indicated by the arrows.
Figure 11:
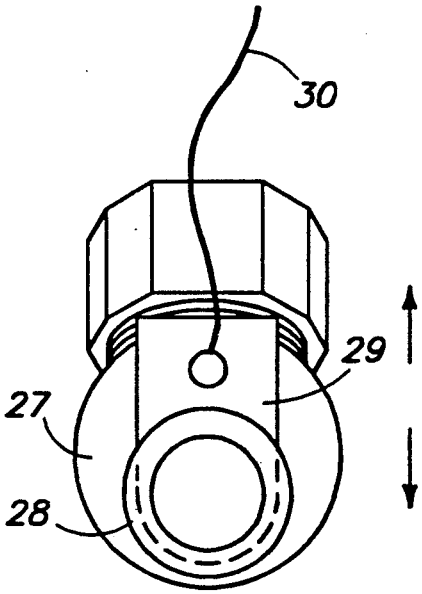
FIG. 11 is an orthographic view, taken along the lines 11—11 of FIG. 10 in the direction indicated by the arrows.

The FIGS. 10–12 illustrate the use of a modified lower lid 27 mounted to each respective lower terminal end of each magazine tube, wherein an alignment tube 28 coaxially aligned with each lower terminal end of each magazine tube includes a slide plate 29 diametrically and slidably directed through each alignment tube in an orthogonal relationship relative to each axis of each alignment tube, wherein a tether line 30 mounted to each slide plate permits manual lifting of each slide plate for the dispensing of an associated paint ball from a respective magazine tube into the aforenoted paint gun as required.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A paint ball magazine apparatus for recharging of a paint gun support, wherein the apparatus includes an upper collar spaced from and parallel a lower collar, and at least one magazine tube orthogonally mounted to the upper collar and lower collar projecting below the lower collar, with the magazine tube of a generally "L" shaped configuration to define an upper magazine tube leg and a lower magazine tube leg, wherein the upper magazine tube leg and lower magazine tube leg are joined together at an arcuate communicating intersection, the upper leg including a transparent lid mounted to an upper terminal end overlying the upper leg, and a lid plate removably mounted relative to the lower distal end of the lower leg.

2. An apparatus as set forth in claim 1 wherein the upper collar includes a row of upper support cylinders defined by a first, second, and third upper support cylinder, wherein the lower collar includes a row of lower support cylinders defined by a first, second, and third lower cylinder, wherein the first upper cylinder is coaxially aligned with the first lower cylinder to define a first cylinder pair, the second upper cylinder is coaxially aligned with the second lower cylinder to define a second cylinder pair, the third upper cylinder is coaxially aligned with the third lower cylinder to define a third cylinder pair, wherein the first cylinder pair mounts a first magazine tube of said at least one magazine tube, the second cylinder pair mounts a second magazine tube, and the third cylinder pair mounts a third magazine tube, wherein each magazine tube is arranged in a parallel relationship relative to one another, wherein the first, second, and third magazine tubes include a respective first, second, and third lower leg arranged parallel relative to one another extending forwardly relative to the lower collar.

3. An apparatus as set forth in claim 2 wherein the upper collar includes a right upper collar loop and a left upper collar loop mounted to the upper collar adjacent the respective first and third magazine tube, and the lower collar includes a respective right lower collar loop and a left lower collar loop mounted to the lower collar adjacent the respective first magazine tube and third magazine tube, and the right and left upper collar loops secure an upper belt thereto, and the right lower collar loop and the left lower collar loop mount a lower belt thereto for securement of the upper belt and the lower belt about a torso portion of an individual.

4. An apparatus as set forth in claim 3 wherein the lid plate relative to the lower distal end of each magazine tube includes an alignment tube coaxially aligned with at least one of said first, second, and third magazine tubes, the alignment tube including a slide plate diametrically directed through the alignment tube orthogonally oriented relative to an axis defined by the alignment tube, and a tether line mounted to an upper terminal end of the slide plate to permit manual lifting of the slide plate.

* * * * *